United States Patent [19]

Fukumoto et al.

[11] 4,336,318

[45] Jun. 22, 1982

[54] ELECTROSTATIC IMAGE DEVELOPING METHOD

[75] Inventors: Hiroshi Fukumoto, Kawasaki; Yoshio Takasu, Tama, both of Japan

[73] Assignee: Canon Kabushiki Kaisha, Tokyo, Japan

[21] Appl. No.: 221,773

[22] Filed: Dec. 31, 1980

[30] Foreign Application Priority Data

Jan. 11, 1980 [JP] Japan ..... 55-1963

[51] Int. Cl.[3] ..... G03G 13/08

[52] U.S. Cl. ..... 430/120; 430/122; 430/106.6; 430/109; 430/110

[58] Field of Search ..... 430/120, 122, 106.6, 430/109, 110

[56] References Cited

U.S. PATENT DOCUMENTS 4,265,997 5/1981 Extra et al. ..... 430/120

*Primary Examiner*—John D. Welsh

*Attorney, Agent, or Firm*—Fitzpatrick, Cella, Harper & Scinto

[57] ABSTRACT

In a method for developing electrostatic images comprising facing an electrostatic image bearing member bearing electrostatic images on the surface to a support member having a toner particle layer on the surface, when the triboelectric charge of the toner is q(c/g), thickness of the toner particle layer, d(mm), is adjusted to satisfy the following formula:

$$3\times10^{-8}<|q.d|<5\times10^{-6}$$

4 Claims, 6 Drawing Figures

ELECTROSTATIC IMAGE DEVELOPING METHOD

BACKGROUND OF THE INVENTION

1. Field of the Invention

The present invention relates to a developing method for electric latent images as formed in electrophotographic processes, electrostatic recording processes and the like.

2. Description of the Prior Art

In electrophotographic processes, electrostatic recording processes and the like there are known various methods for developing electrostatic images such as a magnetic brush developing method, a cascade developing method and a liquid developing method and the like where a two-component developer mainly composed of a toner and a carrier is employed, and these developing methods give stable images of good quality. However, the developing methods employing a two-component developer suffer from undesirable change of image quality due to the variation of the weight ratio of toner to carrier, deterioration of carriers, scattering of toner particles of dry developers, and dissipation of carrier liquids in liquid developers. In order to eliminate such drawbacks, the developing devices are provided with various means for avoiding such disadvantages, for example, an element for detecting an amount of toners and an agitator for toners and carriers, but this results in an undesirable high cost.

There have been recently proposed one component system developing methods so as to avoid the above mentioned problems. For example, Japanese Patent Publication No. 491/1962 discloses an induction developing method where conductive magnetic toner particles are attached to a sleeve containing a magnet and a magnetic brush composed of toner particles is brought into contact with an electrostatic latent image bearing surface. Since the toner is electrically conductive, an electric charge having a polarity opposite to that of the latent image is induced in each toner particle through a magnet brush facing the electrostatic latent image bearing surface. Thus the development is effected by an electric attraction. Such induction developing method has solved various problems concerning a twocomponent developer system and permits small, light and inexpensive developing devices.

The induction developing method is, however, usually applicable to photosensitive papers having a coating of a photoconductor such as zinc oxide photosensitive papers. Since the toner is conductive, it is very difficult to transfer electrically to plain papers or other image receiving members according to an induction developing method. It has been tried to increase electric resistance of toners in an induction developing method for the purpose of improving the transferring property, but in such case, electric resistance of toner is liable to be affected by the environmental conditions such as humidity and the like and the developed image quality and the transferred images are not stable.

In view of the above mentioned drawbacks of development with one-component developer, U.S. Ser. No. 938,101 filed Aug. 30, 1978, proposes a new developing method where imaged portions only are developed with a magnetic toner without the magnetic toner being brought into contact with the electrostatic latent image bearing surface. According to this new developing method, an insulating magnetic toner comprising a resin and magnetic powder is used, and the toner holds a triboelectric charge mainly caused by a supporting member for developers. Since there is used an insulating magnetic toner holding a stable electric charge, good copies can be obtained even when a copying machine including a transferring step is employed.

U.S. Ser. No. 58,435 filed July 18, 1979 discloses a method for improving reproducibility of gradation, thin letters and small letters by applying an alternating bias electric field to a developing vessel in the above mentioned developing system.

SUMMARY OF THE INVENTION

An object of the present invention is to provide a method for development which can produce good image quality free from fog and a clear copy free from blur around the image.

Another object of the present invention is to provide a method for development where the life of developers is long.

According to the present invention, there is provided a method for developing electrostatic images comprising facing an electrostatic image bearing member, bearing electrostatic images on the surface, to a support member having a toner particle layer on the surface, characterized in that when the triboelectric charge of the toner is q(c/g), the thickness of the toner particle layer, d(mm), is adjusted to satisfy the following formula:

$$3\times10^{-8}<|q.d|<5\times10^{-6}$$

DESCRIPTION OF THE PREFERRED EMBODIMENTS

In a conventional two-component type developer, if each toner particle can not hold a constant triboelectric charge, only the toner particle holding the adequate charge can contribute to developing. In this case, toner particles holding the inadequate charge cause fog etc., however, in practice, said toner particles holding inadequate charge are scavenged by a carrier. The scavenged particles again obtain the adequate charge to effect development.

Figure 1:
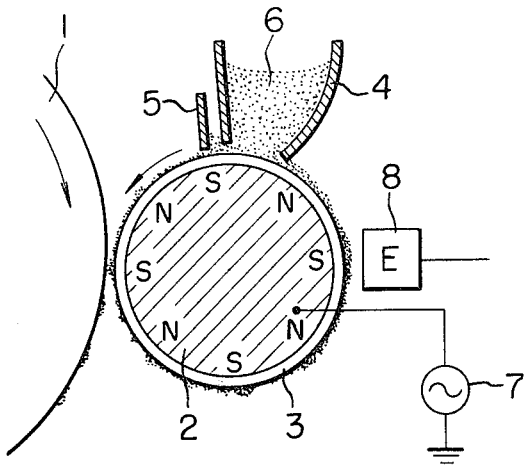
FIG. 1 is a schematic sectional view of a developing device using an insulating magnetic developer.

On the other hand, FIG. 1 shows an embodiment of a developing process in which the present insulating magnetic toner is used. An electrostatic image bearing member 1 rotates in the direction of the arrow as shown in FIG. 1. facing a toner supporting member 3 provided with an inside fixed magnet 2. Toner particle 6 in a hopper 4 is applied onto the surface of toner supporting member 3 in such a manner that a doctor blade 5 controls adequately a thickness of the resulting toner layer. Since insulating and magnetic toner particle 6 contains a ferromagnetic substance, the toner particle layer is agitated by the action of inside fixed magnet 2 or an AC bias 7 while the insulating and magnetic toner particle is carried toward a developing portion on the surface of toner supporting member 3, therefore, each toner particle is fully brought into contact with the surface of the toner supporting member to obtain a sufficient triboelectric charge. Then, a magnetic brush is formed with a magnetic pole at the developing portion to develop an electrostatic latent image by the electrostatic attraction of the latent image. When the polarity of the applied AC bias 7 is the same as that of the toner, the field of the AC bias acts in such a manner that the toner particle is pushed more toward the latent image. On the contrary, when the polarity of the applied AC bias 7 is opposite to that of the toner particle, the field of the AC bias acts in such a manner that the toner particle is pulled back from the electrostatic latent image. As a result, the chance that the magnetic brush of the toner particle is brought into contact with the electrostatic latent image is increased. Therefore, the resulting image is excellent in gradation and reproducibility of a fine line. The toner particle used in said developing process is applied onto the surface 3 of the supporting member in the form of a thin layer, and the whole toner particle layer contributes to the development. In other words, if the charge of each toner particle is irregular and non-uniform, particles which have inadequate charge for development cause fog and unsharpness at an edge of an image. The cause is obvious by considering the foregoing action of the AC bias. Also, since the magnetic brush formed with the magnetic toner has a short length and the scavenging effect by the carrier such as a two-component type developer can not be carried out, it is impossible to inhibit fog.

It is required to produce a toner in which each toner particle bears a uniform and constant charge. This is quite different from the concept that a mean triboelectric charge of total toner particles is important as in the conventional two-component type developer.

Figure 2:
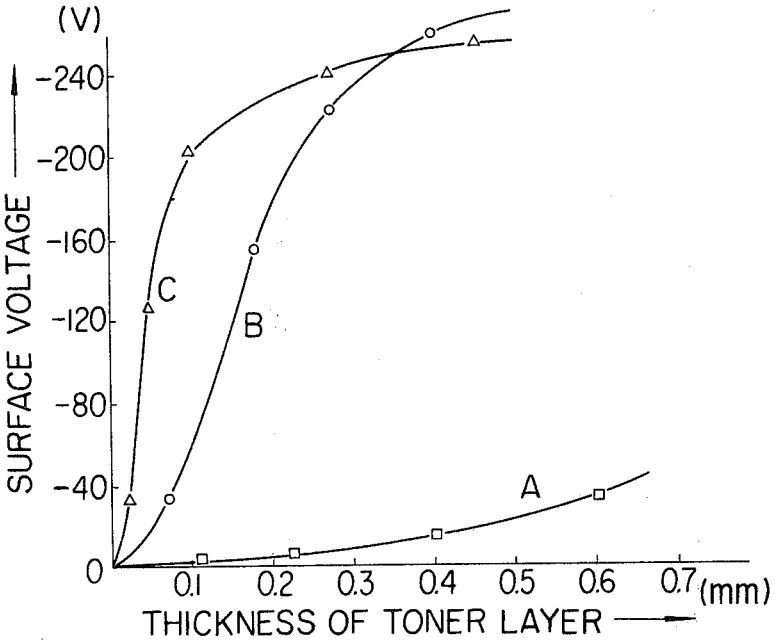
FIG. 2 is a graphic representation indicating a relationship between a surface voltage and a thickness of a toner particle layer formed on a surface of a sleeve, said surface voltage being determined by measuring triboelectric charge generated on particles of toners A, B and C, respectively, as a surface voltage.

In a developing process as shown in a schematic sectional view in FIG. 1, a relationship was investigated between a triboelectric charge of a toner particle and image quality. In other words, after supporting member 3 having a toner particle layer was rotated in the direction of the arrow shown in FIG. 1 by use of a device shown in FIG. 1, the power source of AC bias 7 was grounded and a potential based on a triboelectric charge generated on the surface of the toner particle layer was determined by an electrometer 8. In this case, the intensity of a magnetic field at the potential measuring portion was made the same as that at the developing portion. Using toners A, B and C having various triboelectric chargeabilities as described in Example 1 (infra) and controlling blade 5 for adjusting the thickness of a toner particle layer, with regard to each toner, the thickness of the particle layer and a surface voltage based on a triboelectric charge are measured. A plot of the thickness vs. the surface voltage is shown in FIG. 2, with regard to each toner (A, B or C).

The thickness of the toner layer is a length of a magnetic brush formed with toner particles at the developing portion, and this length was measured by a micrometer. Upon measuring the thickness of the toner layer, there are not applied an electric field based on an electrostatic image and an AC bias at the developing portion. However, particles in a magnetic brush are aligned by the magnetic field based on inside fixed magnet 2.

The triboelectric chargeabilities of toners A, B and C, respectively, were measured by the well known "blow-off method" (for example, "Electrophotography (Japan)" see Vol. 16, No. 2, p. 17, 1978). In this case, small stainless steel balls (75–150 microns), made of the same material as toner supporting member 3 in FIG. 1, were used as the carrier to obtain the triboelectric charge of the toner used.

The triboelectric charges measured by the foregoing method are shown below.

Toner A: $-1.5\times10^{-7}$c/g
Toner B: $-9.8\times10^{-6}$c/g
Toner C: $-3.5\times10^{-5}$c/g On the basis of FIG. 2 and the results of the determination on triboelectric charge, it was found that the surface voltage on the toner supporting member tends to be saturated with increasing thickness of a toner particle layer in case of a toner having a large triboelectric chargeability.

The foregoing tendency is believed to be due to the to agglomeration of highly charged particles in a lower layer caused by electrostatic forces and to an overlying layer of lower charged particles on the highly charged particle layer caused by the magnetic field, in the case of a thick toner particle layer. It is thought that this tendency is remarkable due to the stronger electrostatic attraction to highly chargeable toner particles. Further, if a toner particle layer is made thick, triboelectric charge of each toner particle becomes nonuniform.

Figure 3:
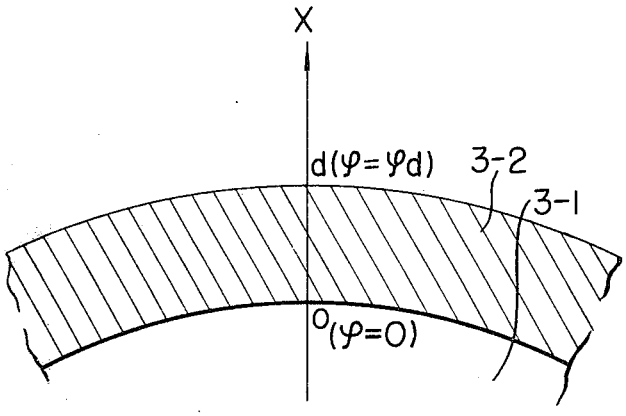
FIG. 3 is an illustration for explaining uniformity of charge of toner particles according to the present invention.

It is concluded that the foregoing consideration is correct based on the following approximate calculation. In other words, a surface voltage generated at the particle layer is calculated by assuming that each toner particle has a uniform charge. As shown in the model of FIG. 3, by assuming that the toner layer (magnetic brush) 3-2 having a uniform charge is formed on the toner supporting member 3-1, the surface voltage $\psi$ is represented as $$\nabla^2\psi = -\frac{\rho}{\epsilon}$$

where $\epsilon$ is the dielectric constant of the toner layer, and $\rho$ is the space charge density thereof on the assumption that $\rho$ is uniform. Since $\psi$ is decided by the thickness direction x in FIG. 3, the foregoing equation becomes $$\frac{\partial^2}{\partial x^2}\psi = -\frac{\rho}{\epsilon}.$$

Therefore, the following equation is obtained.

$$\psi(x) = -\frac{\rho}{2\epsilon}x^2 + C_1x + C_2$$

When it is assumed that x at the surface of the toner supporting member is zero and x at the surface of the toner particle layer is d, $\psi(0)=0$ Therefore $C_2=0$ And $\frac{\partial}{\partial x}\psi(d) = 0$ -continued $$\text{therefore } C_1 = \frac{\rho}{\epsilon} d$$

Accordingly, the surface voltage of the toner particle layer becomes the following.

$$\psi(d) = \frac{\rho}{2\epsilon} d^2$$

$\rho$ can be calculated from the triboelectric charge at the foregoing blow-off method and the applied weight per unit volume. Since the density of the magnetic brush is low, $\epsilon$ can be approximated by the dielectric constant of air.

The toner particle on the surface of the toner support member is scraped by a doctor blade, so that the weight of the toner applied per unit surface is determined. The voltage of the surface of the supporting member for each toner A, B or C, respectively, is calculated based on the weight of the toner applied onto the surface of the supporting member, the thickness of the toner particle layer, and the measured value of triboelectric charge by the blow-off method. As a result, if the thickness of a toner layer applied onto the supporting member is thinner than 0.05 mm, the measured value shown in FIG. 2 is comparatively approximate to the calculated value. A measured value becomes less than a calculated value with increasing thickness of an applied toner layer, and tends to saturate. In other words, when an applied toner layer is very thin, the layer approximates a mono-particle layer on the surface of the supporting member. Therefore, it is considered that the triboelectric charge is uniform as toner particles are mixed with a carrier in blow-off method. When the thickness of the toner layer increases the surface voltage is saturated due to less charge of particles in the upper layer and formation of a particle layer which is nonuniformly charged. It was found that the tendency is pronounced with increasing triboelectric chargeability of a toner. As mentioned above, surface voltage of a toner particle layer on the surface of the supporting member reflects the triboelectric charge of the toner. Upon measuring surface voltage of a toner particle layer, the number of magnetic poles, intensity of the magnet, frequency and intensity of the AC bias, and the like were varied, but surface voltage of a toner particle layer is primarily decided by the characteristics of the material of the toner, the triboelectric series between the supporting members for the toner particle layer and the thickness of the toner particle layer to a certain extent.

The present invention provides a developing method comprising the foregoing developing procedure and a developer having a particular triboelectric chargeability. A triboelectric charge of a toner can be controlled by the characteristics of the material of the supporting member as well as that of the toner.

Based on the foregoing results, the relationship between triboelectric charge and image quality was investigated by use of toners A, B and C having different triboelectric chargeability.

Figure 4:
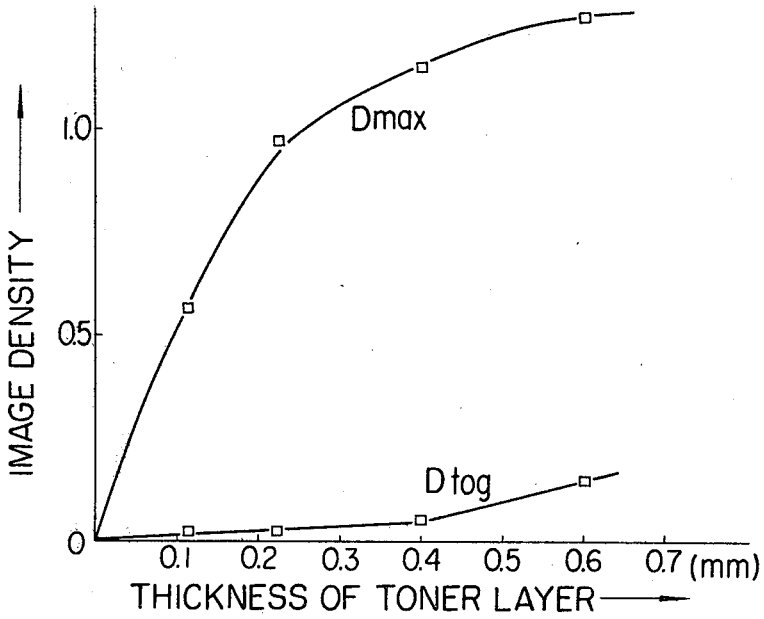
FIGS. 4, 5 and 6 are graphs indicating relationships between a thickness of each toner particle layer formed on a surface of a sleeve and an image density, and between said thickness and a fog density.
Figure 5:
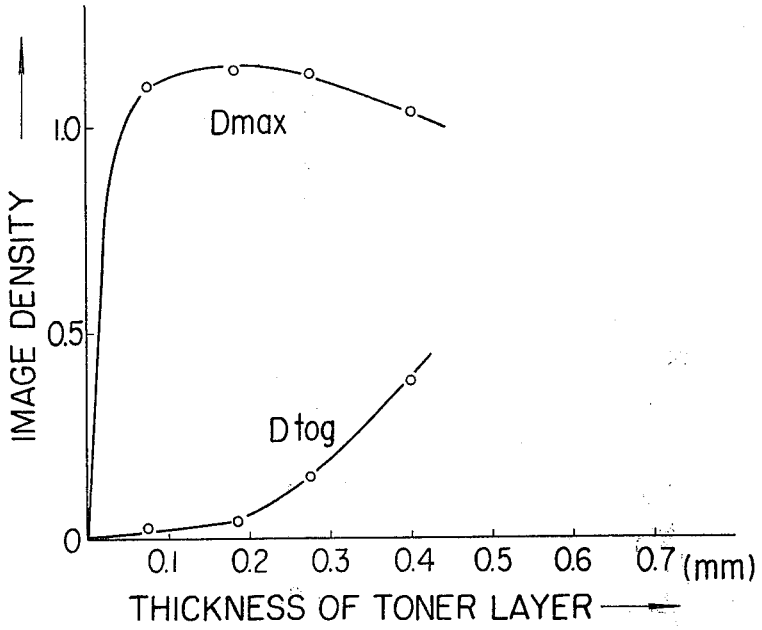
Figure 6:
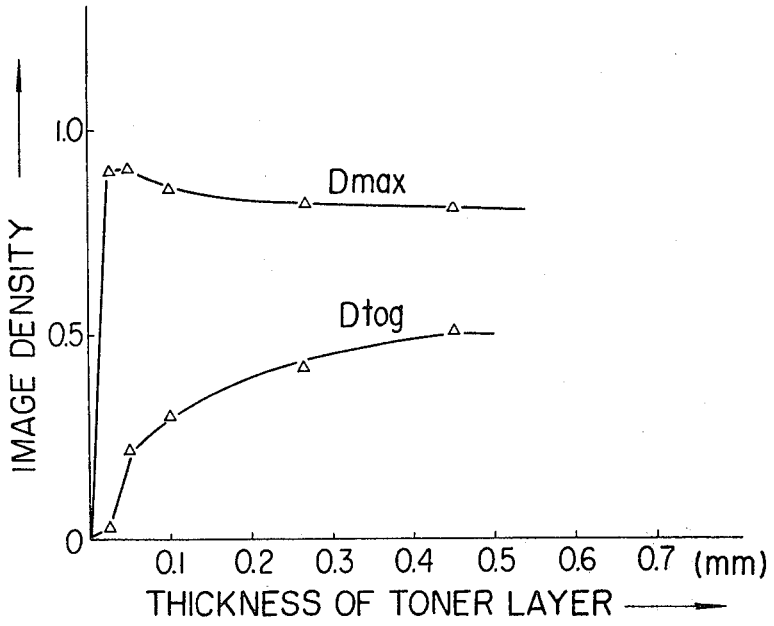

Using the device shown in FIG. 1, a photosensitive member having an insulating layer of polyester on a photoconductive layer of CdS was used as an electrostatic image bearing member 1. A latent image was formed whose potential at the dark portion thereof was +500 V and at the light portion thereof was −20 V, and a development was carried out in such manner that the clearance between the surface of the latent image bearing member and that of the supporting member having toner particles was controlled to slightly larger than the thickness of the toner layer and the two members were rotated in the direction of the arrow in FIG. 1 to effect development. The results obtained are shown in FIGS. 4, 5 and 6 concerning the toners A, B and C, respectively. FIGS. 4, 5 and 6 show plots of the maximum density and a fog density vs. a thickness of a toner layer. Controlling and measurement of the thickness of the toner layer were carried out by the foregoing methods. In FIGS. 4, 5 and 6, $D_{max}$ represents the maximum density of an image and $D_{fog}$ a fog density. Based on FIG. 4, using toner A having lower triboelectric charge, image density is thin when a thin toner layer is used and therefore the thickness of the toner layer is required to be at least 0.2 mm or thicker. When the thickness of the toner layer is 0.5 mm or thicker, fog density increases. Therefore, a suitable image can be obtained in the toner layer thickness range of 0.2–0.5 mm. Using toner B having triboelectric charge higher than that of toner A, a suitable image can be obtained at a thickness of the toner layer ranging from 0.05 to 0.25 mm. Using toner C capable of being most easily triboelectrically charged, a suitable thickness range of the toner layer is narrow and around 0.05 mm based on the maximum density and the fog density, as shown in FIG. 6. Comparing the results shown in FIGS. 4, 5 and 6, and the foregoing relationship between surface voltage of a toner particle layer (FIG. 2) and triboelectric charge thereof, it has been found that the thickness of the toner particle layer which results in a suitable image corresponds to the range in which each toner can hold more uniform charge. Also, FIGS. 4, 5 and 6 show the following:

If the thickness of an applied toner becomes thicker than the required thickness, fog tends to occur and image density decreases due to deposition of low triboelectrically charged toner particles at the upper layer of the toner particle layer; and when a toner has a high triboelectric charge, the toner particle layer capable of maintaining a uniform charge is thin.

Based on the abovementioned results, toners were prepared with various materials to evaluate triboelectric chargeabilities thereof by the blow-off method. Next, a thickness of an applied toner particle layer in which a good image can be obtained was determined, therefore it was found that a good image can be obtained in a relatively limited range with regard to triboelectric chargeability of a toner and thickness of an applied layer thereof. In other words, it was found that a good image can be obtained, when the thickness d(mm) of a toner layer is controlled so as to satisfy the following relationship:

$$3 \times 10^{-8} < |q \cdot d| < 5 \times 10^{-6},$$

preferably $$3 \times 10^{-7} < |q \cdot d| < 3 \times 10^{-6},$$

where q(c/g) represents triboelectric charge of a toner determined by the blow-off method. Accordingly, the thickness of an applied toner layer is required to obtain a good image is defined by knowledge of the inherent triboelectric chargeability of the toner, according to the novel developing method of the present invention. As shown in the abovementioned unit, inherent triboelectric chargeability of a toner is depending upon the specific gravity of a toner, however there is a slight difference in specific gravity of various practical toners which are prepared under consideration of fixing and the like. Accordingly, triboelectric chargeability of a toner is not affected by specific gravity of a toner.

Comparing FIGS. 4, 5 and 6, the higher the inherent triboelectric chargeability of a toner, the thinner the toner layer necessary for producing an image having high density. This result is based on the difference of density of a magnetic brush formed on the surface of the supporting member. In other words, it was found that the density of a magnetic brush becomes thin with decreasing triboelectric chargeability. In the case of toner C having high triboelectric chargeability, the density of a magnetic brush becomes thin with increasing thickness of a toner layer. As the foregoing consideration, the result of measuring the weight of an applied toner shows that toner particles having higher triboelectric charge deposit in the lower layer of the toner particle layer formed on the surface of the supporting member by electrostatic power, and toner particles having lower triboelectric charge overlie the lower layer by magnetic field. In the case of a toner having low triboelectric charge, good image density to a certain degree can be obtained by increasing the thickness of an applied toner layer. However, in the case of a toner having lower triboelectric charge than that of toner A, when increasing the thickness of an applied toner layer, fog density increases with increasing image density. Accordingly, the triboelectric charge of a toner is required to be at least $|10^{-7}|$c/g. In the case of a toner such as toner C having high triboelectric chargeability, the thickness range of an applied toner layer in which each toner particle bears a uniform charge is narrow, and a suitable value of triboelectric chargeability is $|4\times10^{-5}|$c/g at the highest under consideration of mechanical accuracy of thickness adjustment.

Further, when inherent triboelectric chargeability of a toner deviates from the foregoing $|10^{-7}$–$4\times10^{-5}|$c/g, durability of a toner tends to decrease. For example, using a toner having a triboelectric charge lower than $|10^{-7}|$c/g, upon continuous copying, image density was unstable, and the density decreases or partial ghost image occurs with increasing copied sheets. In the case of a toner having a triboelectric charge higher than $|4\times10^{-5}|$c/g, a toner particle layer on the surface of the supporting member became uneven, a portion of a copied image was omitted since toner particles strongly fixed on the surface of the supporting member by electrostatic power could not contribute finally to development. The reason for these phenomena is not yet clear, but it is considered that a toner having suitable triboelectric chargeability may be required to form a stable toner particle layer. Preferably, using a toner having a triboelectric charge in the range of $|5\times10^{-7}$–$3\times10^{-5}|$c/g, development was carried out with the broadest latitude.

As understood from the abovementioned explanation, in the novel developing process, it is necessary that each toner particle of an applied layer has more uniform charge, and the quality of a copied image and the durability of a toner are decided by the triboelectric chargeability of a toner used and the thickness of an applied toner layer.

The thickness of a toner particle layer can be adjusted by a position of the blade or use of a magnetic blade depending upon triboelectric chargeability of a toner. As facts which decide quality of a copied image intensity of the fixed magnet, intensity and frequency of the AC bias, and the like were investigated; however, the effects of these factors were substantially smaller than those of triboelectric chargeability of a toner and of a thickness of an applied toner which is decided by triboelectric chargeability of the toner. Therefore, in practice, reproducibility of a fine line, gradation and the like were slightly influenced by these factors.

The toner used in the present invention comprises fundamentally, as main components, resin and magnetic particle, and if necessary, additives such as a charge controlling agent and a coloring agent. Volume restistivity of a toner may be in the range of $10^{13}$–$10^{16}$ ohm.cm.

Dispersibility or amount of addition of the magnetic powder has a delicate effect on triboelectric chargeablity and uniformity thereof. As a result of the inventors' investigation, it was found that 10–70 percent by weight, preferably 20–50 percent by weight, of magnetic powder based on the total amount of toner should be well-kneaded and mixed with the resin component. As the magnetic powder, there may be used metals and alloys thereof such as iron, manganese, nickel, cobalt, chromium and the like, or magnetite, hematite, various ferrites in the form of fine particles of less than 10 microns in size. It is also effective to use an additive such as a surfactant, a silane coupling agent and the like for dispersing the magnetic powders in the toner.

As the resin component, any types of binders which are usually used in toners are effective. Representative examples are homopolymers of styrene and its derivatives such as poly(styrene), poly(p-chlorostyrene), poly(vinyltoluene), and the like; copolymers of styrene such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer, and the like; poly(methyl methacrylate), poly(butyl methacrylate), poly(vinyl chloride), poly(vinyl acetate), poly(ethylene), poly(propylene), polyester, poly(urethane), polyamide, epoxy resins, poly(vinyl butyral), poly(acrylate) resin, rosin, modified rosin, terpene resins, phenolic resin, aliphatic or cycloaliphatic hydrocarbon resins, aromatic petroleum resins, chlorinated paraffin, paraffin wax, and the like. These resins may be used alone or in combination.

A process for preparing the toners used in the present invention may be any one of the conventional processes. For instance, a method may be used which comprises adding additives such as a charge-controlling agent and the like to the main components (i.e., resins and magnetic powders), fusing and pulverizing them to produce a toner, or a method may be used which comprises dissolving all ingredients in an adequate solvent, dispersing and spray-drying them to produce a toner. Further, in order to avoid non-uniformity of charge to be generated on the toners depending upon the individual size of the particles, it is preferable to subject same to a classification step. In this case, by adjusting the size of the toner particles to approximately 4–40 microns, the fluidity of the toner particles is increased and more uniform triboelectric charge is formed on the support member of the developer.

According to another aspect of the present invention, there is provided a developing method wherein said developing method comprises the steps of:

defining a developing zone wherein a latent image bearing member and a non-magnetic conductive member carrying a layer of magnetic toner particles on the surface thereof are disposed in opposed relationship with a clearance between the surface of the latent image bearing member and the surface of the non-magnetic conductive member, the clearance being greater than the thickness of said toner layer so as to create an air gap;

providing a magnetic field in said developing zone;

moving said latent image bearing member and said non-magnetic conductive member in the same direction; and imparting an alternating electric field sufficient to produce electric fields across said developing clearance.

The following are embodiments of the present invention which should not be construed as limiting the present invention.

Example 1

Five types of toners having different triboelectric chargeability shown in the Table 1 were prepared as follows. 100 Parts by weight of a copolymer of styrene-butyl acrylate-monobutyl maleate having an average molecular weight of 180,000, 50 parts by weight of magnetic powder ($Fe_3O_4$ powder of 0.3 micron of average diameter) and 0–4 parts by weight of a metal complex dye (Zapon Fast Black, tradename, manufactured by BASF) were mixed and ground in a ball-mill, and were fused-kneaded in a roll-mill. After cooling, the resultant product was roughly crushed in a hammer-mill and was powdered in a jet pulverizer. The resulting powder was classified with an air elutriator, and particles of 5–30 microns were obtained as a developing agent. By mixing 100 parts by weight of the said developing agent with 0.05–0.4 parts by weight of hydrophobic colloidal silica, five types of toners, A, B, C, D and E were obtained. The compositions of these toners and their measured triboelectric charges are shown in the following Table 1.

TABLE 1

| Sample of Toner | Composition (Parts by weight) Resin | Magnetic Powder | Controlling agent | Colloidal Silica (*1) | Triboelectric charge (c/g) | Suitable thickness of toner layer (mm) | Image with suitable toner layer $D_{max}$ | $D_{fog}$ |
|---|---|---|---|---|---|---|---|---|
| A | 100 | 50 | 0.5 | 0.2 | $-1.5 \times 10^{-7}$ | 0.20 ~ 0.50 | 0.98 | 0.01 |
| B | 100 | 50 | 2 | 0.2 | $-9.8 \times 10^{-6}$ | 0.05 ~ 0.25 | 1.15 | 0.01 |
| C | 100 | 50 | 2 | 0.4 | $-3.5 \times 10^{-5}$ | 0.05 | 0.95 | 0.02 |
| | | | | | | | (Reference value) | |
| D (Reference Example 1) | 100 | 50 | 0 | 0.05 | $-0.7 \times 10^{-7}$ | none | 0.60 | 0.15 |
| E (Reference Example 2) | 100 | 50 | 4 | 0.4 | $-4.1 \times 10^{-5}$ | none | 1.00 | 0.40 |

(*1) Added parts by weight based on 100 parts by weight of toner

The toners thus obtained were used in a developer shown in FIG. 1, wherein the material of support member sleeve 3 is the same type of stainless steel as that of the carrier which was used in the triboelectric measurement, and the magnetic flux density of the internal fixed magnet was 700 gausses.

The thickness of the toner particle layer on the support member sleeve 3 was controlled to 0.02–1.0 mm by adjusting the gap distance between the surface of the sleeve 3 and an aluminum blade 5.

The coating thickness of toner particles corresponds to the length of the magnetic brush (average value of lengths measured at five points at the developing portion) at the developing portion as illustrated in FIG. 1. The length was measured whenever the position of blade 5 was changed.

Development was carried out by rotating an electrostatic image retaining drum 1 and support member sleeve 3 with equal speed in the direction of the arrow shown in the drawing. The distance between drum 1 and sleeve 3 was adjusted to a length which was the same as or slightly larger than the thickness of the coated toner layer.

The suitable thickness of a toner layer for triboelectric chargeability of each toner was judged on the basis of the quality of images obtained by electrostatically transferring developed images to a plain paper.

An electrostatic latent image was formed a photosensitive drum on which a CdS photoconductive layer covered with an insulating polyester layer was formed, wherein the potential of the latent image was +500 volts in its dark portion and −20 volts in its light portion. At the developing portion, an electric bias on the sleeve surface was applied with 200 Hz, −200 to +400 volts of alternating electric field.

The thickness of each toner layer which gives at least 0.02 of fog density and 0.9 or more of density contrast is as shown in Table 1. From Table 1, a product of coated thickness d(mm) and triboelectric charge g(c/g) for each toner A, B and C having adequate triboelectric chargeability can be calculated as below where the clear copy is obtained $$|q.d|(A)=3.0\times10^{-8}\text{-}6.5\times10^{-8}$$

$$|q.d|(B)=4.9\times10^{-7}\text{-}2.5\times10^{-6}$$

$$|q.d|(C)=1.8\times10^{-6}$$

On the contrary, a toner (D) having $-1\times10^{-7}$(c/g) or less of triboelectric charge produced only foggy copies with the maximum density as low as 0.06, the maximum density even when the thickness of the toner particle layer was more than 0.7 mm. A toner (E) having at least $-4\times10^{-5}$(c/g) of triboelectric charge provided a coated toner particle layer with stripe-like unevenness even at thickness of the layer as thin as 0.5 mm or less, and further gave unclear and foggy images.

Example 2

Three kinds of toners B, D and E prepared in Example 1 were subjected to a durability test. The conditions of development were the same as those of Example 1 except that the thicknesses of the toner particle layer as illustrated in Table 2 were used. The maximum density and fog density under the respective durations are shown in Table 2. As is clearly seen from Table 2, a toner B having an appropriate triboelectric chargeability gave stable images, while a toner D having small triboelectric chargeability gave images having remarkable variations in density up to the first 1,000 copies and thereafter gave decreasing densities. In addition to the above, toner D created partly reversal images after a series of 10,000 copies. Toner E, having a larger triboelectric chargeability showed a relatively stable maximum density, and after a series of 100 copies there was found non-uniform thickness of the toner layer resulting in lacking images partly.

TABLE 2

| Toner Sample | Thickness of toner layer (mm) | $D_{max}$ / $D_{fog}$ No. of sheet copies 1 | 1000 | 5000 | 10000 |
|---|---|---|---|---|---|
| B | 0.075 | 11.5/0.01 | 1.17/0.01 | 1.09/0.01 | 1.15/0.01 |
| D | 0.40 | 0.50/0.12 | 0.78/0.18 | 0.36/0.17 | 0.31/0.20 |
| E | 0.03 | 1.00/0.40 | 1.18/0.32 | 1.12/0.45 | 1.20/0.33 |

Example 3

With the toners A, B, C, D and E which were prepared according to Example 1, a suitable thickness of each toner was determined, under various conditions such that the magnetic flux density of the fixed magnet was adjusted to 600, 800 and 1,000 gausses. Test results are shown in Table 3 below.

TABLE 3

| Magnetic flux density of fixed magnet | Thickness of toner for obtaining suitable image (mm) Toner A | Toner B | Toner C | Toner D | Toner E |
|---|---|---|---|---|---|
| 600 gaus | 0.15–0.4 | 0.05–0.2 | 0.05 | none | none |
| 800 gaus | 0.2–0.5 | 0.05–0.25 | 0.05 | none | none |
| 1000 gaus | 0.2–0.5 | 0.07–0.25 | 0.05–0.07 | none | none |

From Table 3, even where the characteristics of the fixed magnet were changed, the thickness of the toner particle layer which gives a proper image was almost constant, while toners having inadequate triboelectric charge failed to produce clear images.

Example 4

Referring to the developer of FIG. 1, wherein a surface of a support member was coated with a thin layer of poly (4-vinyl-1-methyl pyridine), a triboelectric chargeability for each of toners A, B, C, D and E was as follows; toner A: $-1.1\times10^{-6}$c/g, toner B: $-2.0\times10^{-5}$c/g, toner C: $-4.2\times10^{-5}$c/g and toner D: $-1.5\times10^{-7}$c/g. Toners A,, B and D give images with high contrast and without fog, when the thickness of the toner was adjusted to the range of 0.05–0.5 mm, while toner C possessed inadequately large triboelectric chargeability, and gave only unclear and foggy images even at a layer thickness of less than 0.05 mm. Also, the layer formed of toner C was uneven and non-uniform.

Example 5

In order to eliminate fog image which was given by the toners D and E having inadequate triboelectric chargeability as shown in Example 1, the positive parts of the alternating biases were adjusted to +600 V and +800 V from +400 V. However, the maximum density of images was lowered as fog decreased, and reproducibility of a thin line original was poor. On the contrary, toners A, B and C produced clear images although the range of the thickness of the toner particle became narrower.

Example 6

Toners were prepared according to the preparation of toner B in Example 1 except that the amounts of magnetic powders were 25, 75 and 100 parts by weight, respectively. These toners, designated as F, G and H, were tested according to the method of Example 1 and the test results for triboelectric charge and suitable thickness of the toner particle layer are shown in Table 4 in comparison with those of toner B.

As is clearly seen from Table 4, when the amount of magnetic powder increases, the tendency to produce foggy images becomes lower even if the thickness of the toner layer is larger, and simultaneously the triboelectric chargeability is lowered. Especially, in the case of Toner H, a triboelectric charge of as low as $-10^7$c/g was formed. Consequently, only 0.60 of image density was obtained even when increasing the thickness of toner to more than 0.5 mm.

TABLE 4

| Toner sample | Weight of magnetic powder (weight parts) | Tribo-electric charge (c/g) | Suitable thickness of toner particle layer (mm) | Image quality at suitable thickness of toner particle layer $D_{max}$ | $D_{fog}$ |
|---|---|---|---|---|---|
| B | 50 | $-9.8\times10^{-6}$ | 0.05–0.25 | 1.15 | 0.01 |
| F | 25 | $-1.3\times10^{-5}$ | 0.05–0.20 | 1.25 | 0.01 |
| G | 75 | $-4.8\times10^{-7}$ | 0.15–0.40 | 0.90 | 0.01 |
| | | | | (Reference value) | |
| H | 100 | $-0.9\times10^{-7}$ | none | 0.60 | 0.03 |

Examples 7–12

The process of Example 1 was repeated to prepare negatively chargeable magnetic toners as shown in Table 5. These toners were evaluated in the same manner as the toner of Example 1, and consequently these toners were able to produce clear images by adjusting the distance between the blade and the sleeve surface to 0.05–0.5 mm.

TABLE 5

| | Composition of toner (Parts by weight) Resin | Magnetic powder (*1) | Controlling, agent (*2) | Collodial Silica (*3) | Triboelectric charge (c/g) | Quality of images $D_{max}D_{fog}$ | Adequate lq . dl |
|---|---|---|---|---|---|---|---|
| Example 7 | Polyester resin of bisphenol A and pthalic acid | | A | | | | $9.0\times10-7$ \| |
| | 100 | 50 | 2 | 0.2 | $-9.0\times10^{-6}$ | 1.10/0.01 | $2.7\times10^{-6}$ |
| Example 8 | Copolymer of styrene-maleic | | | | | | $7.0\times10^{-7}$ |

TABLE 5-continued

| | Composition of toner (Parts by weight) | | | | Triboelectric | Quality of | |
|---|---|---|---|---|---|---|---|
| | Resin | Magnetic powder (*1) | Controlling, agent (*2) | Collodial Silica (*3) | charge (c/g) | images $D_{max}D_{fog}$ | Adequate lq . dl |
| | anhydride | | | | | | |
| | 100 | 50 | — | — | $-3.5 \times 10^{-6}$ | 1.20/0.02 | $1.4 \times 10^{-6}$ |
| Example 9 | Copolymer of styrene-maleic anhydride | | | | | | $1.1 \times 10^{-6}$ |
| | | 50 | — | 0.2 | $-1.5 \times 10^{-5}$ | 1.35/0.001 | $2.7 \times 10^{-6}$ |
| Example 10 | Styrene-modified epoxy resin | | B | | | | $4.5 \times 10^{-8}$ |
| | 100 | | B | | | | |
| | | 50 | 2 | 0.2 | $-4.0 \times 10^{-7}$ | 0.95/0.2 | $2.8 \times 10^{-7}$ |
| Example 11 | Polystryrene | | | | | | $6.0 \times 10^{-7}$ |
| | 100 | | B | | | | |
| 0.3 | | | 50 | 2 | $-2.0 \times 10^{-5}$ | 1.10/0.02 | $1.4 \times 10^{-6}$ |
| Example 12 | Copolymer of styrene-butyl- | | | | | | $3.2 \times 10^{-7}$ |
| | 100 | | A | | | | |
| | | 50 | 2 | 0.2 | $-8.0 \times 10^{-6}$ | 0.95/0.01 | $1.8 \times 10^{-6}$ |
| Reference Example 13 | Copolymer of styrene-maleic anhydride | | B | | | | |
| | 100 | 50 | 2 | 0.2 | $-4.2 \times 10^{-5}$ | 1.10/0.30 | None |
| Reference Example 4 | Styrene-modified epoxy resin 100 | 50 | — | 0.2 | $-4.2 \times 10^{-7}$ | 0.60/0.18 | None |

(*1) Magnetic powder: $Fe_3O_4$ of 0.3 micron in average diameter
(*2) Controlling agent: A: Zapon Fast Black B, B: Chelate compound of chroma-salicylic acid
(*3) Parts by weight based on 100 parts by weight of toner.

Example 13–15

The process of Example 1 was repeated to prepare positively chargeable magnetic toners as shown in Table 6. These toners were evaluated in the same manner as the toner of Example 1 except for utilizing a ZnO photosensitive paper on which an electrostatic latent image was produced having a potential of −15 V at the light portion and −450 V at the dark portion. As a result, these toners were able to produce clear images by adjusting the distance between the blade and the sleeve surface to 0.05–0.5 mm.

TABLE 6

| | Composition of toner (Parts by weight) | | | | Triboelectric | Quality | |
|---|---|---|---|---|---|---|---|
| | Resin | Magnetic powder (*1) | Gilsonite | Colloidal silica (*2) | charge (c/g) | images $D_{max}/D_{fog}$ | Adequate lq . dl |
| Example 13 | Copolymer of styrene-butyl-methacrylate-vinylpyridine | | | | | | $9.5 \times 10^{-7}$ |
| | 100 | 50 | 3 | — | $2.0 \times 10^{-5}$ | 1.10/0.1 | $1.8 \times 10^{-6}$ |
| Example 14 | Polystyrene 100 | | | | | | $4.0 \times 10^{-7}$ |
| | | 50 | 5 | 0.2 | $8.0 \times 10^{-6}$ | 1.00/0.01 | $1.1 \times 10^{-6}$ |
| Example 15 | Copolymer of styrene-butyl-methacrylate-acrylamine | | | | | | $6.3 \times 10^{-8}$ |
| | 100 | 50 | — | 0.2 | $7.0 \times 10^{-7}$ | 0.95/0.01 | $2.9 \times 10^{-7}$ |
| Reference Example 5 | Copolymer of styrene-butyl-mathacrylate-vinylpyridine | | | | | | |
| | 100 | 50 | 5 | 0.4 | $4.0 \times 10^{-5}$ | 1.25/0.60 | None |
| Reference Example 6 | Copolymer of styrene-butyl-acrylate-acrylamine | | | | | | |
| | 100 | 50 | 5 | — | $0.9 \times 10^{-7}$ | 0.50/0.04 | None |

(*1) Magnetic powder: $Fe_3O_4$ *of 0.3 micron in average diameter*
(*2) Parts by weight of colloidal silica treated with coupling agent of amine-type silane, based on 100 parts by weight of toner.

What we claim is:

1. A method for developing electrostatic images comprising facing an electrostatic image bearing member bearing electrostatic images on the surface to a support member having a toner particle layer on the surface, characterized in that when the triboelectric charge of the toner is q(c/g), thickness of the toner particle layer, d(mm), is adjusted to satisfy the following formula:

$$3\times10^{-8} < |q.d| < 5 = 10^{-6}$$

2. A method according to claim 1 in which the absolute value of triboelectric charge of the toner is in the range of from $1\times10^{-7}$ to $4\times10^{-5}$(c/g).

3. A method according to claim 1 in which the thickness of the toner particle layer, d(mm), is 0.05–0.5.

4. The developing method according to claim 1, wherein said developing method comprises the steps of:

defining a developing zone wherein a latent image bearing member and a non-magnetic conductive member carrying a layer of magnetic toner particles on the surface thereof are disposed in opposed relationship with a clearance between the surface of the latent image bearing member and the surface of the non-magnetic conductive member, the clearance being greater than the thickness of said toner layer so as to create an air gap;

providing a magnetic field in said developing zone;

moving said latent image bearing member and said non-magnetic conductive member in the same direction; and imparting an alernating electric field sufficient to produce electric fields across said developing clearance.

* * * * *

UNITED STATES PATENT AND TRADEMARK OFFICE

CERTIFICATE OF CORRECTION

PATENT NO. : 4,336,318

DATED : June 22, 1982

INVENTOR(S) : HIROSHI FUKUMOTO, ET AL.

It is certified that error appears in the above-identified patent and that said Letters Patent is hereby corrected as shown below:

Col. 1, line 45, change "twocomponent" to -- two-component --.

Cols. 11-12 and 13-14, Table 5, in each, "Collodial Silica(*3)" should read -- Colloidal Silica(*3) --.

Cols. 13-14 in Table 5-Continued, in Example 10, under the heading "Controlling Agent(*2), "$B_2$" should read -- $B_2$ --.

Cols. 13-14 in Table 5-Continued, in Example 11, under the headings Magnetic powder (*1), Controlling agent(*2) and Colloidal silica(*3), "___, $B_2$, 2" should read respectively, --50, $B_2$, 0.3--.

Claim 4, line 64 "alernating" should read -- alternating --.

Signed and Sealed this

Fourteenth Day of December 1982

[SEAL]

Attest:

GERALD J. MOSSINGHOFF

Attesting Officer

Commissioner of Patents and Trademarks

UNITED STATES PATENT AND TRADEMARK OFFICE

CERTIFICATE OF CORRECTION

PATENT NO. : 4,336,318

DATED : June 22, 1982

INVENTOR(S) : FUKUMOTO, ET AL.

It is certified that error appears in the above-identified patent and that said Letters Patent is hereby corrected as shown below:

Column 13, line 66, " $< 5=10^{-6}$" should read -- $< 5x10^{-6}$"--.

Signed and Sealed this

Twenty-eighth Day of December 1982

[SEAL]

*Attest:*

GERALD J. MOSSINGHOFF

*Attesting Officer*

*Commissioner of Patents and Trademarks*